US008770215B1

(12) United States Patent
Mudd et al.

(10) Patent No.: US 8,770,215 B1
(45) Date of Patent: Jul. 8, 2014

(54) LOW FLOW INJECTOR TO DELIVER A LOW FLOW OF GAS TO A REMOTE LOCATION

(76) Inventors: Daniel T. Mudd, Reno, NV (US); Patti J. Mudd, Reno, NV (US)

( * ) Notice: Subject to any disclaimer, the term of this patent is extended or adjusted under 35 U.S.C. 154(b) by 184 days.

(21) Appl. No.: 13/555,069

(22) Filed: Jul. 20, 2012

Related U.S. Application Data

(60) Provisional application No. 61/572,700, filed on Jul. 20, 2011.

(51) Int. Cl.
*F17D 1/04* (2006.01)

(52) U.S. Cl.
USPC ..... 137/12; 137/487; 137/487.5; 137/607; 118/715

(58) Field of Classification Search
USPC ..... 137/2, 8, 12, 487, 487.5, 607, 115.13, 137/115.25; 118/715
See application file for complete search history.

(56) References Cited

U.S. PATENT DOCUMENTS

| | | | | |
|---|---|---|---|---|
| 5,439,026 | A * | 8/1995 | Moriya et al. | 137/486 |
| 6,303,501 | B1 * | 10/2001 | Chen et al. | 438/680 |
| 6,422,256 | B1 * | 7/2002 | Balazy et al. | 137/12 |
| 6,799,603 | B1 * | 10/2004 | Moore | 137/597 |
| 7,717,061 | B2 * | 5/2010 | Ishizaka et al. | 118/723 MP |
| 8,340,827 | B2 * | 12/2012 | Yun et al. | 700/282 |
| 8,505,478 | B2 * | 8/2013 | Suekane et al. | 118/696 |
| 2002/0095225 | A1 * | 7/2002 | Huang et al. | 700/50 |
| 2004/0007180 | A1 * | 1/2004 | Yamasaki et al. | 118/715 |
| 2007/0227659 | A1 * | 10/2007 | Iizuka | 156/345.33 |
| 2011/0108126 | A1 * | 5/2011 | Monkowski et al. | 137/12 |
| 2013/0118596 | A1 * | 5/2013 | Horsky | 137/12 |

* cited by examiner

*Primary Examiner* — John Rivell
*Assistant Examiner* — Minh Le
(74) *Attorney, Agent, or Firm* — Law Office of Dorian Cartwright

(57) ABSTRACT

A low flow injector controls remote delivery of low flows of gas. A higher flow carrier gas is provided by an MFC to a conduit. A remote flow restrictor is located to exhaust a critical process gas directly into the conduit. An electronic regulator controls a pressure of the critical gas responsive to a pressure point received from a controller corresponding to a desired mass flow. Also, a large flow restrictor vents the critical process gas.

18 Claims, 6 Drawing Sheets

LOW FLOW INJECTOR TO DELIVER A LOW FLOW OF GAS TO A REMOTE LOCATION

CROSS-REFERENCE TO RELATED APPLICATIONS

This application claims the benefit of priority under 35 U.S.C. 119(e) to U.S. Application No. 61/572,700, filed Jul. 20, 2011, entitled DEVICE AN METHOD TO DELIVER A LOW FLOW OF GAS TO A REMOTE LOCATION, by Daniel T. Mudd et al., the contents of which are hereby incorporated by reference in its entirety.

FIELD OF THE INVENTION

The invention relates generally to gas delivery systems, and more specifically, to delivering a low flow of gas to a remote location.

BACKGROUND OF THE INVENTION

Applications such as semiconductor fabrication processing increasingly require more accurate measurements and quicker and more consistency in timing in the delivery of gases from components such as a mass flow controller (MFC).

FIG. 1 is a schematic diagram illustrating an MFC 100, according to an embodiment of the prior art. Generally, MFC 100 is a device used to measure and control the flow of fluids and gases. MFC 100 has an inlet port 110, an outlet port 120, a mass flow sensor 130, a flow bypass 135, and a control valve 140. The control valve 140 is adjusted in accordance with measurements from the mass flow sensor 130 in order to achieve a desired gas flow. The mass flow sensor 130 can be a thermal sensor, allowing the mass flow to be measured by sensing a temperature profile between the "no flow" and the "at flow" conditions.

Problematically, typical in MFCs using a thermal sensor to measure mass flow, measurements can be inaccurate during inlet pressure transients, because gas flow is measured and maintained at the thermal sensor 130 which is at the inlet of the MFC 100 rather than at the outlet port 120 where gas exits. The changing inlet pressure to the MFC causes the flow into the MFC 100 to be different than the flow out of the MFC outlet port as additional mass enters the MFC 100 to pressurize the volume between the thermal sensor and the downstream valve seat.

Although a pressure based MFC (or low flow injector) eliminates the measurement location issue by locating a characterized flow restrictor at an outlet port, thus allowing flow measurement at the outlet of the MFC (or injector), gas delivery, from both pressure based and thermal based MFC, can suffer from slug flow at low flows.

FIG. 2 is a schematic diagram illustrating a system 200 with a pressure based MFC 210 to deliver a low flow gas, thus eliminating pressure issues, according to an embodiment of the prior art. A higher flow MFC 220 delivers a carrier gas that mixes, at the tee where conduits 225 and 215 meet, with the low flow gas to speed up delivery through the system 200. Ideally, the low flow gas of conduit 215 mixes with the higher flow gas of conduit 225 for a desired mixture of gases.

However, a mass flow of the higher flow gas races through the conduit 225 and pressurizes and filling the conduit 225 and the majority of the conduit 215. This pressurization at the onset of gas flow occurs as the flow of gas encounters the inherit flow resistance of the "downstream plumbing" a differential pressure is needed to drive flow. Before the low flow gas can reach the tee where conduits 225 and 215 meet and can mix with the carrier gas, sufficient mass must flow from MF 210 to displace the carrier gas that has partially filled conduit 215 at the onset of the gas flows. The time required for this displacement is roughly equal to the mass of the carrier gas in 215 divided by the flow rate of the low flow gas form 210. The author defines this time delay as a "slug flow" delay as the slug of carrier gas in 215 must be displaced. For flows from 210 of magnitude 10 sccm (standard cubic centimeters per minute) required slug flow delays of 5 to 15 seconds are typical in conventional systems. Delays longer than 1 minute are possible for a 1 sccm flow. These delays are unseen by instrumentation and unknown by many users however it is standard practice to delay "processing" for a period of time after gas flow have begun. Such delays on expensive equipment limit throughput and thus drive up the cost of the product being produces. As a consequence, delivery of the low flow gas into the mixture can be delayed beyond a tolerance of the process and the slug flow delay time can vary depending on the varying volume of the components of different suppliers use in a system.

Additionally, a pressure based MFC can suffer from slow bleed downs. A volume existing between a flow restrictor and an upstream valve seat controlling pressure to the flow restrictor contains a bleed down mass. When an MFC is instructed to stop gas flow, the upstream valve seat is closed, but gas continues to flow through the flow restrictor as the bleed down mass exits. Bleed down is a function of conductance of the flow restrictor. Larger restrictors with larger conductance can be used to speed up the bleed down time, but the tradeoff can be a significant increase in drift and inaccuracy.

What is needed is a robust technique to provide accurate measurements at a point of gas delivery, while minimizing slug flow and bleed down times.

SUMMARY

The present invention addresses these shortcomings by providing a device, a method, and a method of manufacture for low flow injection to control remote delivery of a low flow gas.

In one embodiment, a higher flow carrier gas is provided by an MFC to a conduit. A remote flow restrictor is located to exhaust a critical process gas directly into the flow conduit. A pressure sensor determines a pressure of the critical process gas flow. Additionally, an electronic regulator controls a pressure of the critical gas to the flow restrictor based on a pressure command received from a controller. A resulting pressure generally controls the mass flow through the flow restrictor and exhausting into the carrier gas flow.

If additional accuracy is desired the restrictor temperature and/or gas pressure downstream of restrictor maybe used to correct the target pressure to the electronic regulator to account for these variables affecting mass flow. Instrumentation to read measure these values often already exist in the system but if they do not they can be added and the value either manually or automatically used to correct the target pressure given to the regulator.

In another embodiment, a large flow restrictor is included to vents additional critical process gas to a non-process location. This speeds the response time when a set point of gas delivery is changed to a lower value by a controller. This venting of mass to a non-process location, allows the pressure of to be more rapidly be reduce compared to the time required if the sole mass flow out of was through restrictor. Numerous other embodiments are possible, as described in more detail below.

Advantageously, critical process gas can be quickly and accurately delivered to low tolerance processes such as semiconductor fabrication at a reduced cost, relative to a conventional MFC. In addition, process recipes need not be adjusted to accommodate the slug flow delays associated with the differing internal volumes from components of different manufactures. Furthermore, slug and bleed down times are minimized.

BRIEF DESCRIPTION OF THE DRAWINGS

In the following drawings, like reference numbers are used to refer to like elements. Although the following figures depict various examples of the invention, the invention is not limited to the examples depicted in the figures.

DETAILED DESCRIPTION

A device, a method, and a method of manufacture for low flow injection to control remote delivery of a low flow gas are disclosed. The disclosed techniques can be implemented in a semiconductor fabrication process, or any other environment using low flows of gas or fluid with tight tolerance limits.

Figure 1:
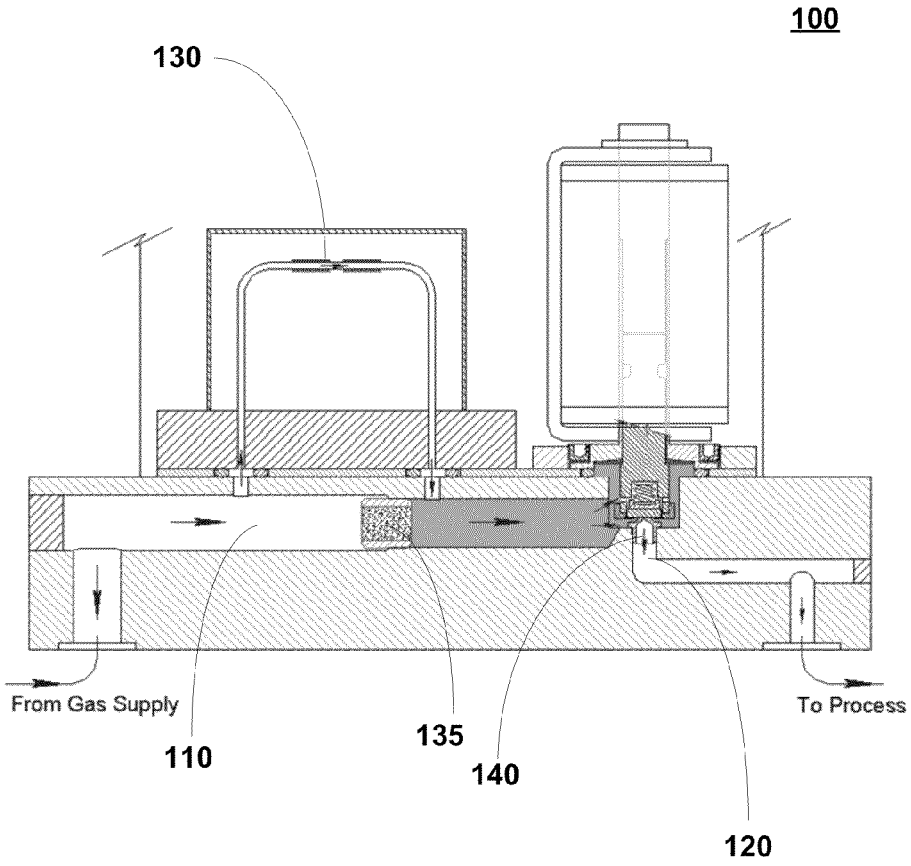
FIG. 1 (Prior Art)
FIG. 1 is a schematic diagram illustrating a thermal sensor based mass flow controller (MFC) i.e. a "thermal MFC", according to a prior art embodiment.
Figure 2:
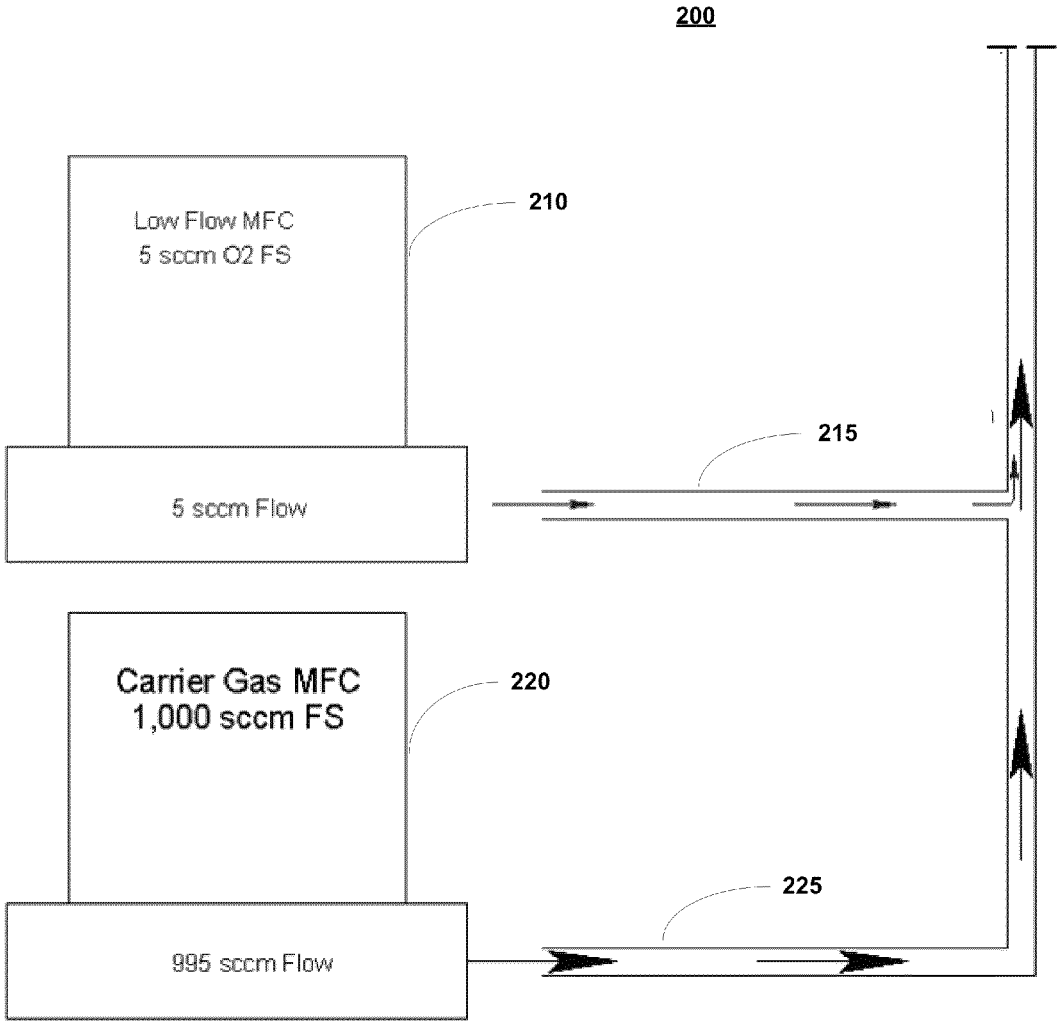
FIG. 2 (Prior Art)
FIG. 2 is a block diagram illustrating a low flow MFC hardware arrangement, according to an embodiment of a prior art embodiment.
Figure 3:
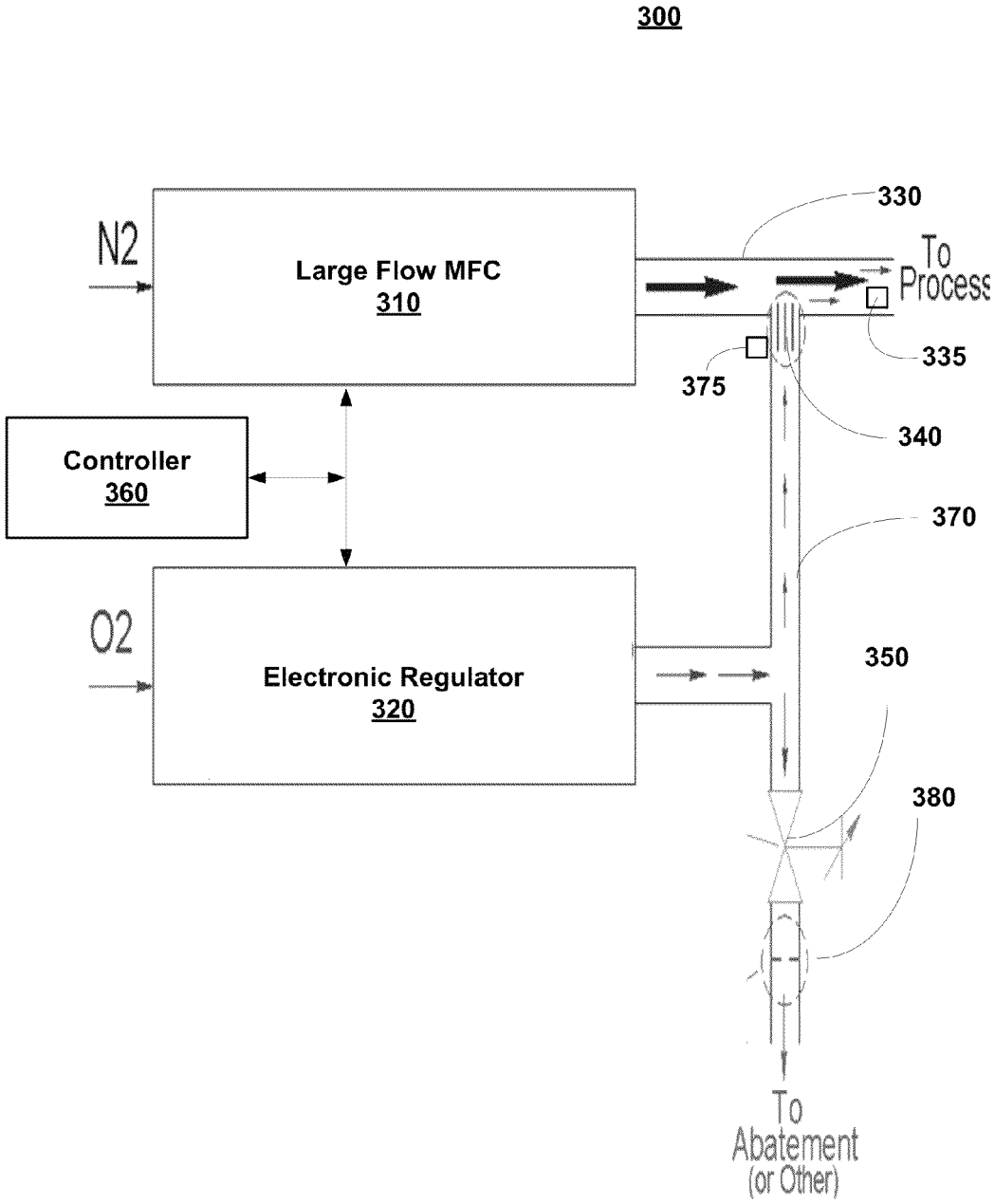
FIG. 3 is a block diagram illustrating a system for low flow injection to deliver a critical process gas, according to an embodiment

FIG. 3 is a block diagram illustrating system 300 for low flow injection for delivery of critical process gas, according to an embodiment. The injector 300 includes a mass flow controller (MFC) 310, an electronic regulator 320 and a controller 360.

The MFC 310 is preferably a large flow MFC, but can be any type of suitable device for gas delivery. The MFC 310 receives, in this case, nitrogen gas at an inlet. In other cases, any type of gas or fluid suitable for a process is supplied. The MFC 310 exhausts the gas into a conduit 330 for delivery to a process. In one embodiment, the gas of the MFC 310 is a carrier gas that has a significantly larger set point relative to the critical process gas. For example, a carrier gas can be delivered at 1,000 sccm (standard cubic centimeters per minute) while a critical process gas can be delivered, directly into the carrier gas by creating a positive pressure drop across a flow restrictor, 340, positioned to exhaust directly into the carrier gas conduit, 330, thus mixing the two gases. The critical process gas leverages the higher mass flow for quicker delivery to a process.

The conduit 330 can be any suitable tubing or plumbing, either rigid or flexible, to deliver gas (or fluid) to the next stage. The conduit 330 can have a diameter of, for example, ¼ inch.

The electronic regulator 320 receives pressure set points associated with a desired mass flow. The electronic regulator 320 receives, in this case, oxygen gas at an inlet, although any suitable gas or fluid can be supplied.

In operation, the electronic regulator 320 sends gas into the conduit 370 to pressurize the conduit 370 to the target pressure, thus directly affecting the flow through the flow restrictor 340. The flow through flow restrictor 340 is predominately affected by the pressure in 370, P1, and secondarily affected by the pressure in 330, P2, and the temperature of the gas flowing through the flow restrictor 340. The temperature of the gas can be accurately assumed to be the temperature of the flow restrictor 340 if it is a laminar flow element. The external surface of the conduit 370 near the flow restrictor 340 is a convenient location to measure temperature indicative of the gas temperature.

The remote flow restrictor 340 can be a valve capable of flow measurement (such as produced by Pivotal Instruments), an orifice (sonic or sub sonic), a venture nozzle (sonic or subsonic), a laminar flow element (in compressible or incompressible flow) or the like. In operation, the remote flow restrictor 340 generally prevents back flow from the carrier gas (as P1 is generally greater than P2, however control algorithm can be included in the electronic regulator 320 if P2 pressure is known to insure P1 equals or greater that P2 to restrict back flow of the carrier gas). Slug flow is minimized by the electronic regulator 320 quickly increasing the P1 pressure to generate the target flow through the flow restrictor 340 which exhaust directly into the carrier gas stream in the conduit 330 relative to a conventional MFC which takes time for sufficient mass flow to displace the carrier gas. In one embodiment, the critical process gas has a low flow value. An exemplary flow of critical process gas into the mixture is 1 sccm at 2000 Torr P1 pressure to the remote flow restrictor 340. The remote flow restrictor 340 can be 300 times more stable than a conventional pressure based MFC using a 300 sccm restrictor at P1=2000 Torr, for the same 1 sccm flows. The conventional MFC uses the large 300 sccm restrictor to avoid unacceptably slow bleed down. The use of the higher flow vent orifice 380 avoids this bleed down issue and allows smaller restrictors to be used. The 1 sccm flow injector will be 300 times more stable/accurate than the 300 sccm restrictor of the conventional MFC for small flows like 1 sccm.

In some embodiments, a temperature sensor 375 and/or a pressure sensor 335 located to measure the pressure of the gas in the conduit 330 downstream of the flow restrictor 340, P2, are located proximate to the remote flow restrictor 340. The thermal sensor 375 can be attached to an exterior surface, or burrowed within. In other embodiments, such measurements are received by the controller 360 as read by an external sensor (e.g., in the gas box). The pressure sensor 335 can be paired with a pressure sensor at a different part of the conduit 330 in order to improve the calculation of P1 thus improving the accuracy of flow (and extend the dynamic range) delivery, such as when P2 becomes more than 10% of P1. For example, when the pressure drop is minimal (i.e., when the pressure of the mixed gas approaches the pressure of the critical process gas), the pressure sensor pair can improve flow accuracy.

The controller 360 can be a computing device, a hand-held instrument, software, embedded microcontroller or the like. The controller 360 receives set points for mass flow and determines based on known restrictor conductance characteristics what pressure is necessary for delivery to the restrictor to deliver the mass flow. The calculations can be based pressure measurements at one location or several locations, and one or more temperature measurements. The controller 360 can be centrally located in order to manage all or a portion of components within a process. In another embodiment, set points can be changed from a non-centralized device that is directly connected. In still another embodiment, set points can be provided manually by an operator.

In some implementations, a semiconductors tool controller and associated software can be modified. In retrofit applications you have limited ability to modify the existing controller software. In such cases a "smart box" need to be added to calculate the P1 value needed to generate the mass flow requested from the existing tool controller.

A large restrictor 380. The large restrictor 380 can be a valve (e.g., a dump valve), orifice (sonic or sub sonic), a venture nozzle (sonic or subsonic), vent or other type of gas flow controller. When a decrease in the mass flow rate through the flow restrictor 340 is desired, set point for the electronic regulator 320 is lowered, however to actually achieve this lower P1 pressure, mass in conduit 370 must be remove. If the gas can only be removed by slowly flowing though the flow restrictor 340 then a significant time must pass to allow the conduit 370 to bleed down. The slow bleed down can delay a process. By adding the large restrictor 380, all or a portion of the gas is quickly vented from the conduit 370. In one embodiment, the large restrictor 380 operates in coordination with an optional valve 350 for a relatively quick change in gas pressure at time when P1 pressure reduction is needed. The valve 350 remains closed saving gas when P1 pressure reduction is not needed. The vented gas is, in turn, sent to abatement. An exemplary flow of the large restrictor is 500 sccm at 2000 Torr, P1 Pressure. The optional valve 350 is closed once the desired pressure is achieved.

Figure 4:
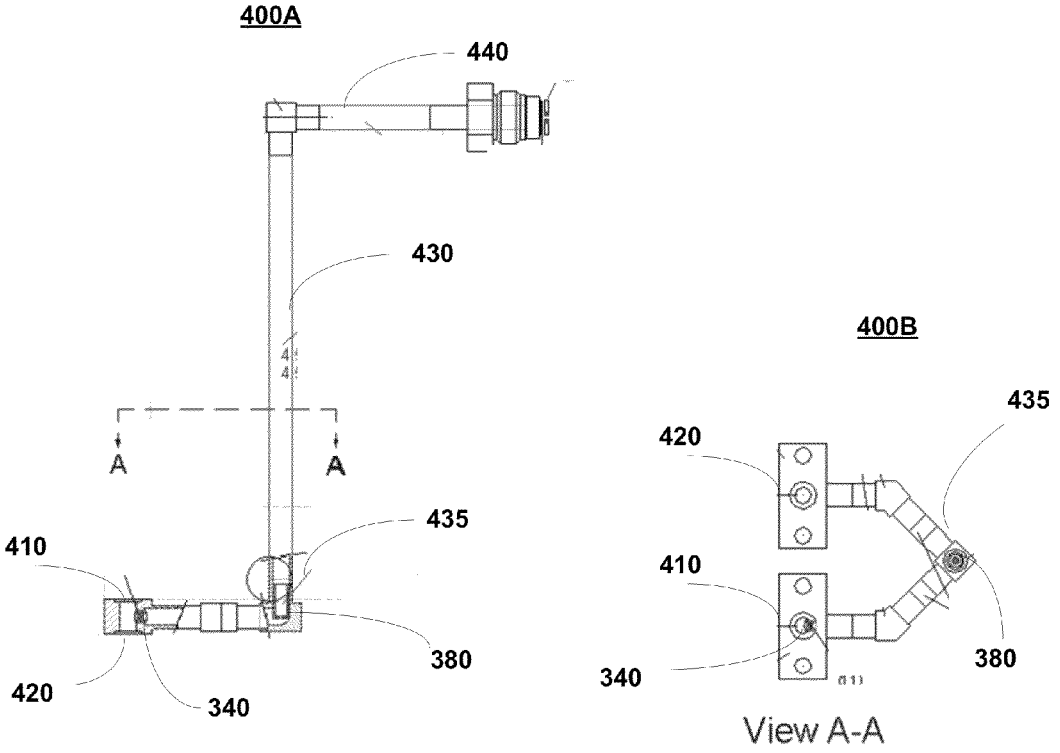
FIG. 4 is a schematic diagram illustrating views of a low flow injector, according to an embodiment.

FIG. 4 is a schematic diagram illustrating views of a low flow injector, according to an embodiment. In particular, the low flow injector is shown from a first view 400A and a section view 400B relative to the first view 400A.

A substrate 410 is shown from a first view and a corresponding section view. In one embodiment, a sintered element, which is a laminar flow element, is pressed into the substrate 410 of an injector. An electronic regulator sits on top of a substrate 420 and pressurizes the conduit between the substrate 420 and a connection 435 (which vents to abatement) and between the connection 435 and the substrate 410 (which the carrier gas MFC sit on top of) to the target P1 pressure associated with the flow desired and mixes with the carrier gas from the MFC sitting on top of 410. Note that the bottom port of the substrate 420 is blocked by a blank seal not shown in FIG. 4. Additionally, the remote restrictor 340 and the optional vent restrictor 380 are shown from a first view and a corresponding section view.

A first section 430 of tubing can be, for example, 4.55 inches post-weld and connect the large restrictor to an elbow. A second section of tubing 440 can be, for example, 1.20 inches post-weld and connects the elbow to an orifice.

To implement, the low flow injector can be retrofitted into existing tools with either thermal or pressure based MFCs. The embodiment of FIG. 4 is designed to retrofit existing systems by adding gas wetted hardware to the weldment assembly shown and spacers. In addition an optional "smart box" control system may be added to improve accuracy by correcting for P2 and ambient temperature. In some embodiments, a low flow injector is retrofitted into a jet stream gas box as produced by Lam Research Corporation.

Figure 5:
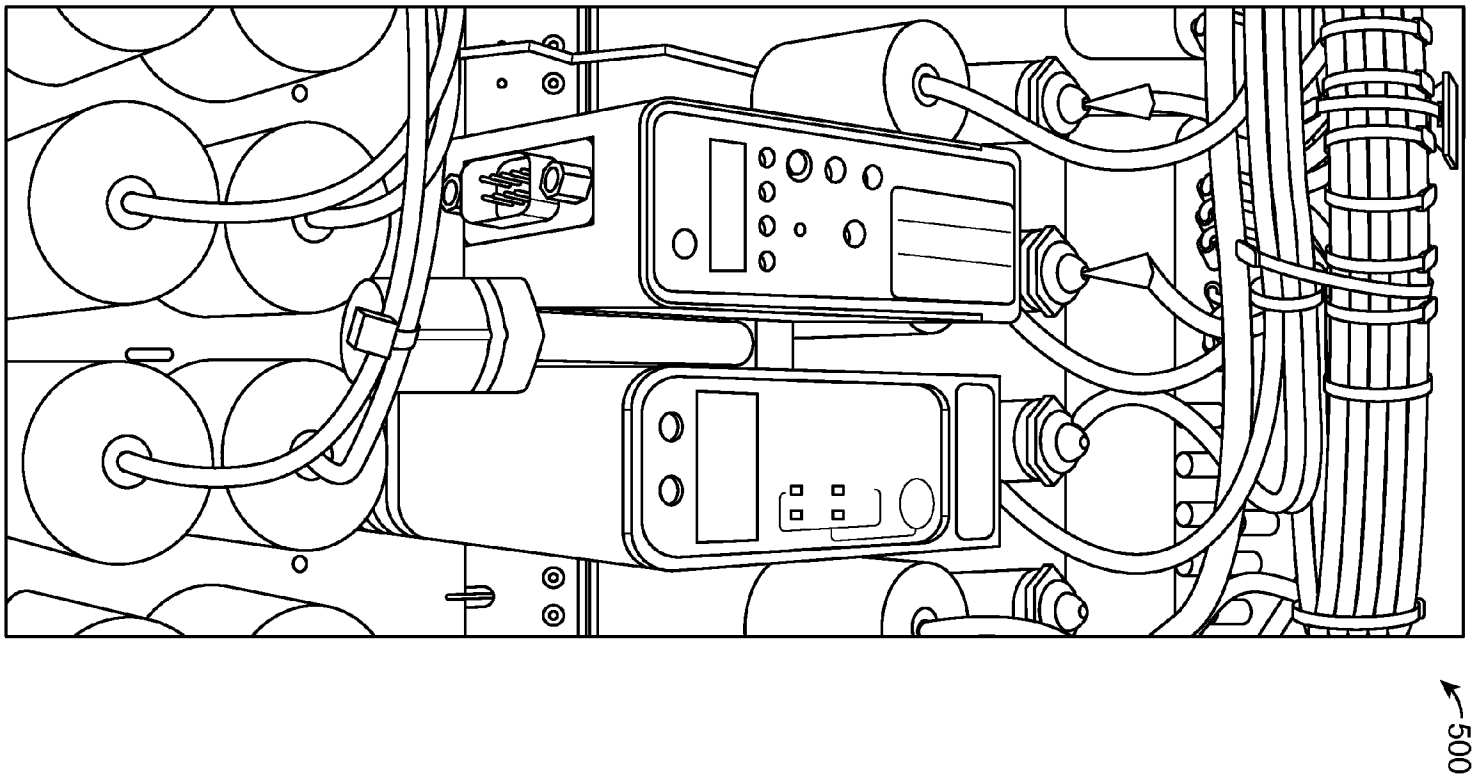
FIG. 5 is a schematic diagram illustrating a low flow injector within an application environment, according to an embodiment.

FIG. 5 is a schematic diagram illustrating a low flow injector within an application environment, according to an embodiment.

Figure 6:
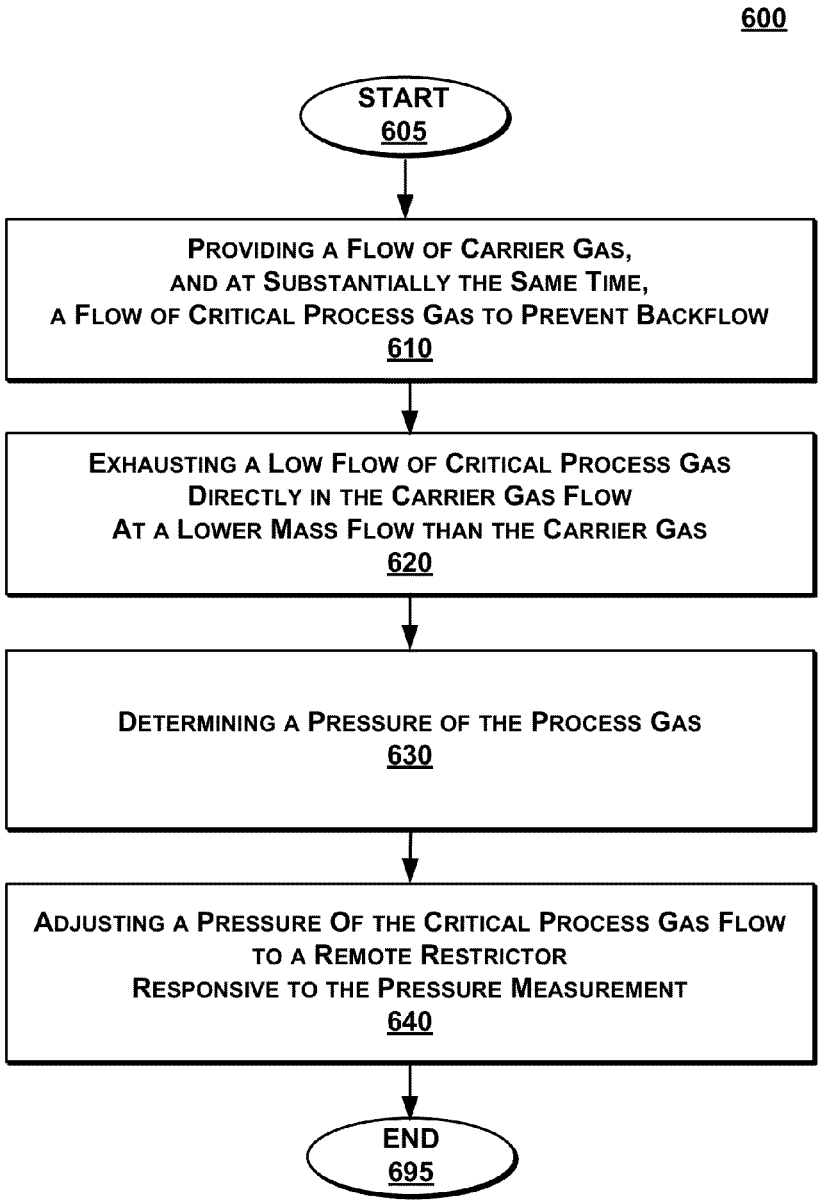
FIG. 6 is a flow diagram illustrating a method for low flow injection for delivery of critical process gas, according to an embodiment.

FIG. 6 is a flow diagram illustrating a method 600 for low flow injection for delivery of critical process gas, according to an embodiment. At step 610, a carrier gas is provided by a large flow MFC at substantially the same time that a critical process gas if provided by an electronic regulator. Pressure in a branch conduit (e.g., the conduit 370) is built up to a target pressure associated with the desired process application mass flow. Because the branch conduit is pressurized at the same time, back flow is substantially precluded. At step 620, a low flow of critical process gas is exhausted directly in the carrier gas flow at a lower mass flow than the carrier gas. The mass flow of the carrier gas can be, for example, 10 times or 20,000 times greater than the mass flow of the critical process gas.

At step 630, an optional step, the temperature of critical process gas and the P2 pressure of the gas downstream of the low flow restrictor is determined. At step 640, a pressure of the critical process gas flow to a remote restrictor is controlled to provide the desired flow rate of the critical process gas. Optionally the target P1 pressure may be modified responsive to the temperature and the P2 pressure of the gas downstream of the low flow restrictor to improve mass flow accuracy of the delivered process gas for current ambient conditions.

Optionally, the critical process gas is vented when a set point of gas delivery is changed by a controller.

This description of the invention has been presented for the purposes of illustration and description. It is not intended to be exhaustive or to limit the invention to the precise form described, and many modifications and variations are possible in light of the teaching above. The embodiments were chosen and described in order to best explain the principles of the invention and its practical applications. This description will enable others skilled in the art to best utilize and practice the invention in various embodiments and with various modifications as are suited to a particular use. The scope of the invention is defined by the following claims.

We claim:

1. A low flow injector to control remote delivery of low flows of gas, comprising:

a gas conduit having a proximal end and a distal end;

a remote flow restrictor located at the distal end of the gas conduit to exhaust a flow of a critical process gas from the gas conduit directly into a flow of a carrier gas, wherein a mass flow of the carrier gas is provided by a mass flow controller (MFC) at a higher mass flow than the critical process gas; and an electronic regulator located at a proximal end of the gas conduit to pressurize the gas conduit at substantially the same time as the MFC provides the carrier gas to prevent backflow of the carrier gas into the gas conduit, and to adjust a pressure of the critical process gas flow through the gas conduit to the remote flow restrictor based on a pressure set point command, the pressure set point command associated with a desired mass flow of the critical process gas.

2. The low flow injector of claim 1, further comprising:

a large flow restrictor to relieve pressure to the remote flow restrictor by venting the critical process gas from the gas conduit.

3. The low flow injector of claim 1, wherein:

the electronic regulator receives the pressure set point command from a controller based on a desired mass flow of the critical process gas, and wherein the controller maps the pressure set point command based on a conductance of the remote flow restrictor known by the controller.

4. The low flow injector of claim 3, further comprising:

wherein the controller receives a second pressure measurement corresponding to pressure of a mixture of gas subsequent to the remote flow restrictor, and wherein the controller determines the pressure set point command based on at least the desired mass flow of the critical process gas and the second pressure measurement.

5. The low flow injector of claim 3, further comprising:

wherein the controller receives a temperature measurement corresponding to a temperature proximate to the remote flow restrictor, and wherein the controller determines the pressure set point command based on at least the desired mass flow of the critical process gas and the temperature measurement.

6. The low flow injector of claim 5, wherein:

the controller receives a second pressure measurement corresponding to pressure of a mixture of gas subsequent to the remote flow restrictor, and wherein the controller determines the pressure set point command based on at least the desired mass flow of the critical process gas, the second pressure measurement and the temperature measurement.

7. The low flow injector of claim 1, wherein the remote flow restrictor comprises one of:

an orifice, a laminar flow element, a nozzle, a sonic nozzle, a sonic venturi, and a subsonic nozzle or venturi.

8. The low flow injector of claim 1, wherein the mass flow of the carrier gas is at least 10 fold greater than the mass flow of the critical process gas.

9. The low flow injector of claim 1, wherein the mass flow of the carrier gas is at least 10,000 fold greater than the mass flow of the critical process gas.

10. A method in a low flow injector for controlling remote delivery of low flows of gas, comprising:

exhausting a flow of a critical process gas from a gas conduit directly into a flow of a carrier gas, wherein a mass flow of the carrier gas is provided by a mass flow controller (MFC) at a higher mass flow than the critical process gas;

pressurizing the gas conduit at substantially the same time as the MFC provides the carrier gas to prevent backflow of the carrier gas into the gas conduit; and adjusting by an electronic regulator a pressure of the critical process gas flow through the gas conduit to a remote flow restrictor located at an distal end of the gas conduit based on a pressure set point command, the pressure set point command associated with a desired mass flow of the critical process gas.

11. The method of claim 10, further comprising:

relieving pressure to the remote flow restrictor by venting the critical process gas from the gas conduit.

12. The method of claim 10, further comprising:

receiving the pressure set point command from a controller based on a desired mass flow, wherein the controller maps the pressure set point command based on a conductance of the remote flow restrictor known by the controller.

13. The method of claim 12, further comprising:

measuring the pressure of the critical process gas prior to reaching the remote flow restrictor, wherein the controller receives a second pressure measurement corresponding to pressure of a mixture of gas subsequent to the remote flow restrictor, and wherein the controller determines the pressure set point command based on at least the desired mass flow of the critical process gas and the second pressure measurement.

14. The method of claim 12, further comprising:

measuring the pressure of the critical process gas prior to reaching the remote flow restrictor, wherein the controller receives a temperature measurement corresponding to a temperature proximate to the remote flow restrictor, and wherein the controller determines the pressure set point command based on at least the desired mass flow of the critical process gas and the temperature measurement.

15. The method of claim 14, wherein:

the controller receives a second pressure measurement corresponding to pressure of a mixture of gas subsequent to the remote flow restrictor, and wherein the controller determines the pressure set point command based on at least the desired mass flow of the critical process gas, the second pressure measurement and the temperature measurement.

16. The method of claim 10, wherein the remote flow restrictor comprises one of:

an orifice, a laminar flow element, a nozzle, a sonic nozzle, a sonic venturi, and a subsonic nozzle or venturi.

17. The method of claim 10, wherein the mass flow of the carrier gas is at least 10 fold greater than the mass flow of the critical process gas.

18. The method of claim 10, wherein the mass flow of the carrier gas is at least 10,000 fold greater than the mass flow of the critical process gas.

* * * * *